US007304600B2

(12) United States Patent
Nehls et al.

(10) Patent No.: US 7,304,600 B2
(45) Date of Patent: Dec. 4, 2007

(54) BLUETOOTH REMOTE CONTROLLER USING ZIPPER INTERFACE

(75) Inventors: Johannes Nehls, Heidelberg (DE); Rebecca Allen, Los Angeles, CA (US)

(73) Assignee: Media Lab Europe (In Voluntary Liquidation), Dublin (IE)

( * ) Notice: Subject to any disclaimer, the term of this patent is extended or adjusted under 35 U.S.C. 154(b) by 159 days.

(21) Appl. No.: 11/303,040

(22) Filed: Dec. 15, 2005

(65) Prior Publication Data

US 2006/0164280 A1 Jul. 27, 2006

Related U.S. Application Data

(60) Provisional application No. 60/636,602, filed on Dec. 16, 2004.

(51) Int. Cl.
*G08C 17/00* (2006.01)

(52) U.S. Cl. ..... 341/176; 340/825.69

(58) Field of Classification Search ..... 341/176; 340/825.69; 200/550, 531, 536, 571, 572, 200/252

See application file for complete search history.

(56) References Cited

U.S. PATENT DOCUMENTS 4,603,327 A 7/1986 Leonard et al.
6,596,955 B2 7/2003 Eves et al.

*Primary Examiner*—Brian Zimmerman
*Assistant Examiner*—Hung Q Dang
(74) *Attorney, Agent, or Firm*—Charles G. Call

(57) ABSTRACT

A wireless remote control device for transmitting control commands to a Bluetooth™ enabled electronic device, such as a television set, an audio player, or a cellular telephone by manipulating the zipper in a garment, handbag or the like. The zipper fastener consists of opposing rows of interlocking teeth attached to a pair of elongated flexible supports and a manually movable sliding traveler that locks and unlocks said teeth at is moves longitudinally along the length of said flexible supports. A sensor is coupled to said zipper fastener for generating a position signal that indicates the current position of said sliding traveler with respect to said supports, and a Bluetooth™ transmitter coupled to said sensor sends control commands indicative of the current position of the slider and the state of a pushbutton attached to the slider.

11 Claims, 2 Drawing Sheets

BLUETOOTH REMOTE CONTROLLER USING ZIPPER INTERFACE

CROSS REFERENCE TO RELATED APPLICATIONS

This application claims the benefit of U.S. Provisional Patent Application Ser. No. 60/636,602 filed Dec. 16, 2004, the disclosure of which is incorporated herein by reference.

FIELD OF THE INVENTION

This invention relates to controllers for sending commands to remotely located electronic devices.

BACKGROUND OF THE INVENTION

In 1917, Gideon Sundback obtained U.S. Pat. No. 1,219,881 for a 'Separable Fastener' and designed a manufacturing machine for the fastener. The popular name came from the B. F. Goodrich Company which used the name for on a new type of rubber boots or galoshes and renamed the Sundback fastener the "zipper". In the 1930's, the zipper came into widespread when the fashion industry adopted it for garments, handbags, and other items, and continues to be widely used throughout the world.

Zippers commonly take one of three different forms. Coil zippers employ a slider (also called the "traveler") that runs on two coils which form the "teeth" of the zipper. The coils may be in a spiral form, usually with a cord running inside the coils. Metallic zippers use teeth formed from individual shaped pieces of metal attached to a tape support membrane at uniform intervals. Plastic molded zippers are formed like metallic zippers, but the individual teeth are plastic instead of metal, and have the advantage that the plastic can be dyed to the color of the garment. Plastic molded zippers are commonly seen in jackets and backpacks and other items where the zipper is exposed.

U.S. Pat. No. 4,603,327 issued to Leonard et al describes a zip fastener for a garment that includes a pair of electrical contacts at one position along its length such that opening of the zip causes a circuit to open to issue a warning signal.

British Patent Application 2,307,346A by McGlone describes a detector consisting of spaced flexible strips which carry contacts and extend down the back of a garment so that, if the wearer bends her back, an alarm is sounded.

U.S. Pat. No. 6,596,955 issued to Eves et al. describes a modified zipper fastener consisting of two strips of fabric which hold arrays of interlocking teeth that are locked and unlocked by the movement of a slider. The fabric establishes electrical connections between adjacent teeth using a conductive thread or conductive ink. Moving the traveler causes an increase or decrease in length of the electrical path through the teeth and the traveler, and therefore a change in resistance, so that the modified zip fastener acts as a potentiometer that can be used, for example, to control the volume of an audio system built into a garment.

SUMMARY OF THE INVENTION

The present invention uses a zipper as an input device/interface for a digital remote controller that can be used to control an electronic device that is coupled to the controller by a standard interface, such as a digital USB or wireless communication link using a standard protocol such as the AT command set or the Bluetooth™ Human Interface Device (HID) Profile.

More particularly, the present invention is a zipper operated remote controller that can be used to transmit command signals to a Bluetooth™ enabled electronic device, such a television set, an audio player, a cellular phone, a PDA, or the like.

A preferred embodiment of the invention takes the form of a Bluetooth™ remote control device for transmitting control commands to a Bluetooth™ enabled electronic device by manipulating the zipper in a garment, handbag or the like. The fastener portion of the zipper is conventional, and consists of opposing rows of interlocking teeth attached to a pair of elongated flexible support membranes (typically fabric tapes) and a manually movable sliding traveler that locks and unlocks the teeth at is moves along the length of the flexible support membranes. A sensor is coupled to the zipper fastener for generating a position signal that indicates the current position of the sliding traveler with respect to the longitudinal support membranes, and a Bluetooth™ transmitter coupled to the sensor sends control commands indicative of the current position of the slider and the state of a manually operated pushbutton switch attached to the slider.

The parameters readable from the zipper are the degree of to which the zipper is opened or closed, as well as the velocity or acceleration of the zipper's slider motion as it is opened or closed. Additionally a button switch attached to the slider enlarges the potential use of the zipper controller by permitting the user to perform additional functions, such as switching between multiple modes, indicating a selection of a particular position, or for other control purposes. When augmented with a button switch, the zipper provides not only signal value which is continuously variable in a range between a totally open and totally closed position, but also permits the user to move the zipper to a selected position and then "select" an output value using the button. Thus, the zipper controller may be used to perform functions often performed by other control devices, such as the scroll wheel on a mouse, a rotary or sliding dial control, or the directional keys on a keyboard or the track pad. Thus, the zipper may be used to accurately control such functions as adjusting the volume on an audio player, selecting a playback position on a recorded voice message or other audio file, or even selecting and entering letters and numbers from an alphabet of available characters, thus operating as a keyboard.

These control functions can be provided without detracting from the zipper's ability to act as a fastener. Thus, for example, the zipper controller may be implemented using zipper that closes a carrying case for an audio player, and also be used as a convenient volume control or to select particular songs, or playback positions within songs, as indicated by a scrolling display on the player.

BRIEF DESCRIPTION OF THE DRAWINGS

In the detailed description which follows, frequent reference will be made to the attached drawings, in which.

DETAILED DESCRIPTION

The description that follows explains the structure and operation of various preferred embodiments of the invention, including embodiments different kinds of zippers, including zippers with both metallic and plastic teeth, as well as mechanisms for transmitting control signals indicative of the position and/or motion of the zipper's slider to a utilization device that is coupled to the zipper controller, typically by means of a wireless communication link that implements a standard interface protocol between the zipper controller and the utilization device, such as the Bluetooth HID protocol or the AT command set protocol.

Figure 1:
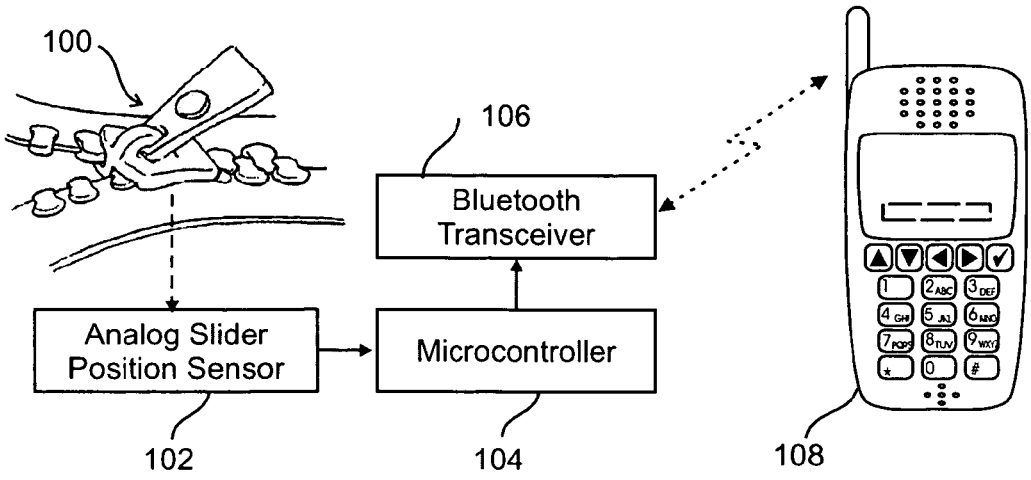
FIG. 1 is block schematic diagram illustrating the operation of the invention.

The operation of the invention is illustrated in FIG. 1. A zipper controller includes a manually movable slider seen at 100 which moves longitudinally along the length of the zipper, either closing the zipper by urging opposing teeth into engagement with one another, or when moved in the opposite direction, opening the zipper by disengaging the teeth. The position of the slider is detected (in various ways to be described) by a position sensing mechanism indicated schematically at 102 in FIG. 1. The position sensor delivers a signal to a microcontroller 104 which converts the position signal into suitable form for transmission via a Bluetooth™ transceiver 106 to a Bluetooth™ capable utilization device, illustrated in FIG. 1 by a Bluetooth™ enabled cellular telephone handset. A manually operated pushbutton 109, discussed later, is placed on the pull-tab attached to the slider 100.

Controller and Utilization Device Connections Using Standard Protocols

The functionality of both portable and fixed electronic devices has been dramatically extended and improved by the advent of improved short range wireless connectivity provided by Bluetooth™ radio transmitters which are now widely incorporated into new electronic devices. The Bluetooth™ radio is built into a small microchip and operates within a globally available frequency band. The Bluetooth™ specification defines two power levels: a lower power mode with a range of about 10 meters for covering a personal area within a room, and a higher power level with a range of about 100 meters covering a larger area, such as a home or office. Software controls and identity coding built into each microchip ensure that only those units preset by their owners can communicate, and provide a mechanism for identifying other devices that are within range. Many remotely controlled electronic devices are coupled to external control devices using the short range Bluetooth™ capability.

The Specification of the Bluetooth™ System, Version 2.0 (2004) available at https://www.Bluetooth™.org/spec describes the details of the Bluetooth™ protocol. In addition, the HUMAN INTERFACE DEVICE (HID) PROFILE VERSION 1.0 defines how devices with Bluetooth™™ wireless communications can use the HID Protocol initially to discover the feature set of a human interface device (HID), and then communicate with the HID. A HID (Human Interface Device) is the device providing the service of human data input and output to and from the host. Because the USB specification's definition of HID includes all devices that report data in a similar fashion to HIDs. Examples of HIDs are mice, joysticks, gamepads, keyboards, and also voltmeters and temperature sensors. The HID is normally the slave in the Bluetooth™ piconet structure. The host is the device using or requesting the services of a Human Interface Device. Examples would be a personal computer, handheld computer, gaming console, industrial machine, or data-recording device. The host is normally the master in the Bluetooth™ piconet structure. Thus, the zipper controller contemplated by the present invention may be advantageously implemented as a Bluetooth™ Human Interface Device conforming top the HID Profile, and in that way perform the functions provided by other kinds of peripheral controllers, such as mice, joysticks and gamepads.

Alternatively, a direct serial connection using, for example, a USB port or a serial data RS-232 port, or a USB connection implemented with a wireless link, may be used to transfer control commands directly from the zipper to a connected utilization device. The Bluetooth™ module 108 may be a class 2 module WML-1019 ABN from Mitsumi Electric Co. Ltd., Tokyo, Japan. The commands may take the form of AT commands of the type originally used by computers to communicate with modems. Since virtually every newer mobile phone has built in wireless modem capabilities, AT commands became the de facto standard language for controlling such devices, mobile phone products and other devices can often be controlled by mapping zipper and zipper button movements to appropriate AT commands or to commands which conform to the HID Protocol noted above.

As a further alternative, an infrared communication link conforming to the IrDA Serial Infrared Data Link Standard promulgated by the Infrared Data Association may be used to transfer control commands from the zipper controller to a nearby utilization device. The IRDA data link standard is which is widely used with notebook computers, mobile phones, and other handheld devices communicating over distances up to 1 meter may also be employed. U.S. Pat. No. 6,091,530 issued to Duckworth on Jul. 18, 2000, the disclosure of which is incorporated herein by reference, describes a low-cost, low-power, half-duplex communication system that can be used to provide data transfer from the zipper controller to a utilization device. In that system, an LED is used as an infrared emitter and exhibits negligible standby power consumption as well as low power consumption during data transfer. Such an infrared link has the disadvantage that line-of-sight exposure between the controller and the utilization device must exist, limiting its utility to applications in which controller and the utilization device are within view of one another.

A Metallic Zipper Controller

Figure 2:
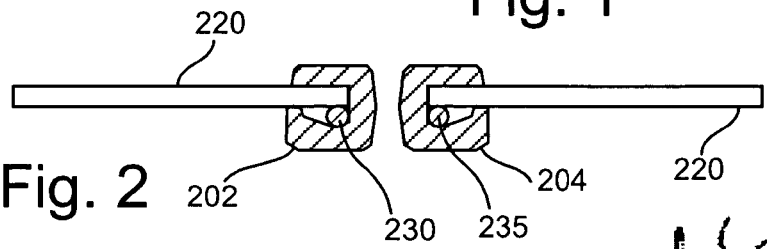
FIG. 2 is a side, cross-sectional view illustrating the manner in which a resistive wire interconnects rows of metallic teeth in one embodiment of the invention.

A first embodiment of the invention uses a metallic zipper in which the metallic zipper teeth are interconnected by a resistance alloy wire which passes between the clamps formed by the metal zipper's teeth as seen FIG. 2. As seen at 202 and 204, each of the teeth forms a clamp whose upper and lower walls are pressed together to secure the tooth element to the zipper tape seen at 220. The tooth 202 also clamps and secures a metallic alloy wire 230 which runs longitudinally alone the sequence of teeth including tooth 220 on one side of the zipper, while the tooth 204 claims and secures a metallic alloy wire 235 which extends longitudinally along the other side of the zipper, joining the teeth including tooth 204. The slider (traveler) 240 is also metallic and provides a conductive pathway for current flowing from the open end of the zipper through the metallic alloy wire 230 to the slider 240 and then along the circuit pathway provided by the metallic alloy wire 235 back to the open end of the zipper.

The two metallic alloy wires 230 and 235 establish an electrical connection between each of the zipper elements (e.g. its teeth) and thus across the entire metal zipper. The alloy wires are built into the zipper when it is fabricated at the same time the teeth are clamped to the zipper tape 220. Alternatively, a pathway providing a resistive electrical connection between each pair of adjacent teeth in the sequence along each side of the zipper may be achieved by sewing one or more resistance alloy wires into the zipper tape.

Figure 3:
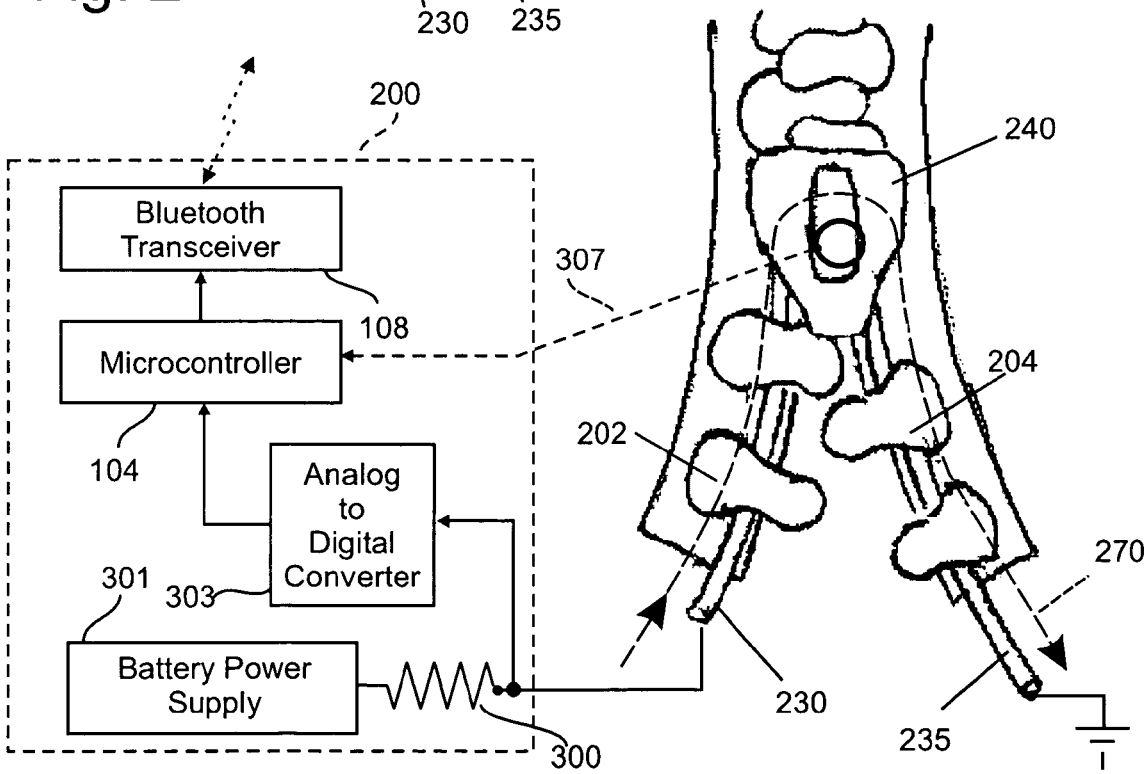
FIG. 3 is a schematic diagram illustrating the structure and function of the metallic zipper remote control device that implements the invention.

When a single wire is used as shown in FIGS. 2 and 3, it may have a maximum diameter of 0.12 mm and consist of a material called ISAOHM® produced by Isabellenhuetten, Dillenburg, Germany, a resistance alloy consisting of nickel, chromium, aluminum, ferric and silicon (NiCr20AISi; DIN Material Code=2.4872). This wire provides an electrical resistivity of around 1.32*10-6 ohms/meter which thereby provides a sufficient change in resistance over the relatively short travel distance of the zipper slider. That specific material also exhibits a high long-term stability and absence of corrosives.

A voltage applied across the two open ends of the metallic alloy wire induces a current illustrated by the dashed line arrow 270 seen in FIG. 3 that flows through the resistive wires 230 and 235 and a electrical connection between these wires created by the slider 204. The opening and closing of the zipper as the slider 240 moves longitudinally results in a longer and shorter current path length, changing the amount of total resistance presented by the wire segments 230 and 235 which are connected at the slider 240. The high resistivity of the wire provides a significant increase or decrease of resistance by even the small movements of zipper slider 240. As seen in FIG. 3, the variable resistance presented by the variable length resistive wire in the zipper is connected in series with a fixed resistance 300 across a regulated voltage source. The change in resistance alters the voltage at the junction of the zipper resistance and the fixed resistor 100 which is applied to the input of an analog-to-digital converter 300 (which may be built into the microcontroller 104). The microcontroller 104 may be implemented by the BX24 microcontroller available from Netmedia Inc., Tucson, Ariz., USA. The microcontroller chip is programmed to detect voltage level changes in its I/O pin and convert it into a digital value which is transmitted by the Bluetooth™ transceiver 108 to one of various remote electronic computing device using a standard controller interface protocol.

A Plastic Zipper Controller

A second method uses a different technique that results in a similar outcome: A zipper controller providing an analog output signal which having a value related to position to which the zipper slider is moved. This approach is particularly useful for plastic zippers, but can also be used in conjunction with metal zippers.

Figure 4:
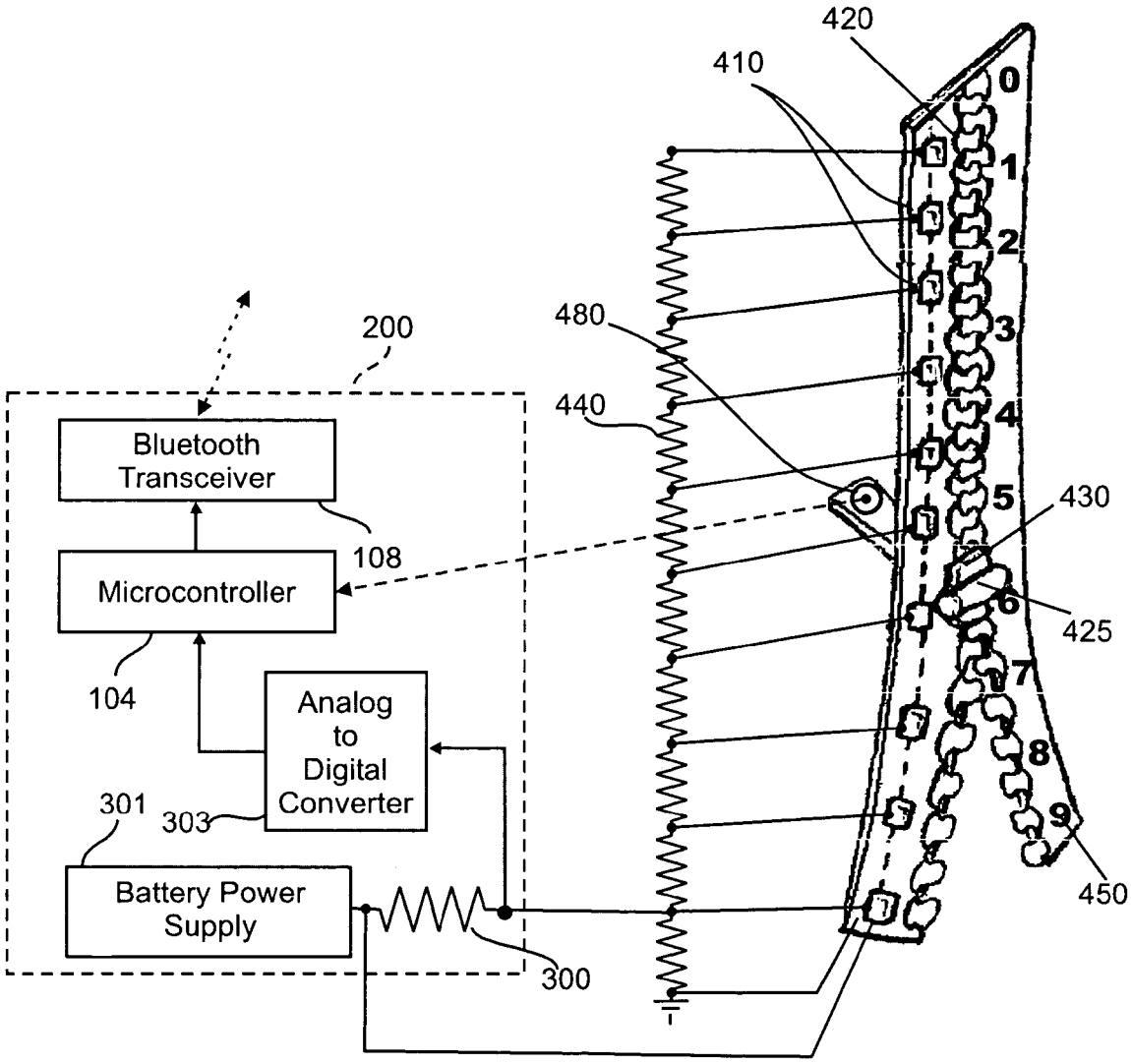
FIG. 4 is a schematic diagram illustrating the structure and function of an embodiment of the invention used with a plastic zipper.

As seen in FIG. 4, an array often Hall effect sensors, two of which are seen at 410, are attached to the back of the zipper tape near too, but spaced from, the zipper teeth 420. Each Hall effect sensor produces an output voltage in response to changes in magnetic field density produced by a magnet 425 attached to the back of a moving zipper slider (traveler) 430. In this application, the Hall effect sensors may be HAL 556 sensors available from Micronas GmBH, Freiburg, Germany. Each Hall effect device is connected between a voltage supply conductor 451 and a grounded connection 452, and delivers an output voltage to a unique tap location on the resistor chain 440. Although shown separately in FIG. 4 for tutorial purposes, the resistor chain 440 may take the form of a resistive wire in the support membrane that connects the Hall effect devices. The Hall effect devices 410 may produce a voltage which continuously increases in magnitude as the magnet 425 draws near, or may be designed to turn ON fully whenever the magnetic flux intensity exceeds a predetermined value. The number of Hall effect sensors 410 determines the granularity (resolution) of the interface. Each Hall effect sensor produces output current that is applied to the junction between two resistors in a chain of series-connected resistors 440. Each resistor in the series 440 has a fixed value, and the total number of resistors connected between each Hall effect device and the grounded connection 450 determines the magnitude of current flowing through the bottom sensing resistor 460.

As a result, when the zipper fastener is closed, the magnet 425 is closest to and activates the bottom Hall effect device, and the maximum current flows through the sensing resistor in the digital interface module 200 (described earlier in connection with FIG. 2), delivering the maximum voltage to an analog-to-digital converter 303. In contrast, when the zipper is fully open and the magnet 425 on the traveler 430 is adjacent the topmost Hall Effect device, current flows the all of the resistors in the chain 440, resulting in only a small current through the sensing resistance 300. The analog-to-digital converter 303 converts the voltage across the resistance 300 into a digital value, and the microcontroller 104 may be programmed to perform a lookup operation to translate that digital voltage level indication into a numerical position indication.

In the arrangement seen in FIG. 4, the ten Hall effect sensors thus deliver a numerical position value 0-9. As seen in FIG. 4, the corresponding digits 0-9 may be printed as visible indicia on the zipper tape, illustrated by the numeral "9" seen at 450, serving as a visual position guide to the user. A user may move the slider to a position adjacent one of the numerals and then use the pushbutton switch on the slider pull tab (as illustrated at 101 in FIG. 1) to select that number. A series of numbers may be selected in sequence using the zipper controller to perform a function like entering an access code to unlock an electronic lock, or dialing a telephone number on on Bluetooth enabled phone.

The small magnet seen at 425 attached to the back of the zip fastener slider's body 430 produces sufficient magnetic flux density to trigger each Hall effect sensor as it passes by. The magnet may be a 6×6 mm neodymium magnet from Eclipse Magnetics, Sheffield, England. The magnet 420 triggers each Hall effect device as it passes by, causing a momentary increase in current through the Hall effect sensor, changing in voltage across the connected fixed resistor 300 which is applied to an input of the analog to digital converter 303. The occurrence of this unique voltage level indicates which Hall effect sensor has been triggered by the proximity of the magnet 425 attached to the traveler. A corresponding digital value is assigned in the microcontroller to each Hall effect sensor. For example if the Hall effect device at the bottom which is triggered when the zipper is completely closed may be assigned the digital output value "9", while the topmost Hall effect device which is triggered when the zipper is completely open is assigned the value "0" These digital values may then be wirelessly transferred via the Bluetooth™ transceiver 108 to a utilization device which is controlled by the zipper movement using a standard interface protocol. Note that, using Hall effect devices, there is no mechanical abrasion caused by friction of the slider on the resistance wire and other mechanical solutions. Hall effect sensors are designed for hostile industrial and automotive applications. Moreover, the Hall effect devices have no physical contacts and therefore are less error prone.

The Button Switch on the Zipper's Slider

Regardless of the mechanism used to detect the position of the zipper slider, it is desirable to attach a button switch to the pull-tab of the zip fastener slider as illustrated at 101 in FIG. 1 and at 480 in FIG. 4. The pressing of the button transmits a command signal via the standard protocol to the utilization device that typically results either in a change of modes or provides a "selection" signal analogous to the button on a mouse. The condition of the button switch may be communicated to the interface module 200 by a direct wire connection, by applying a unique signal to the resistance chain 440, or may be transferred wirelessly to the microcontroller. For example, button switch may be connected to a RT4-433.9 Radio Frequency Transmitter available from Telecontrolli SpA, Italy, and a RR 10 receiver also from Telecontrolli SpA may be placed in the interface module 200 and connected to the microcontroller. The Button switch and transmitter may be powered using a rechargeable battery such as a Lithium-Polymer cell e.g. UBC641739 from Ultralife Batteries Inc, Newark, N.Y., USA. These parts (not shown) are attached on the back of the zipper's slider 430.

Commercial Applications

By combining an analog output control based on slider position with an On-Off selector control using the button switch, the zipper controller may be used to perform many tasks typically performed by traditional interface devices such as a mouse or track pad. The enhanced zipper allows the gradual or analog selection of particular options, such as it those presented by an audio device playlist or song list, or the menu of available telephone numbers in a cellular phone directory.

The mechanism described may be used to control a utilization device based on the whether or not a zipper is open or closed. For example, a cellular phone may be placed in a carrying bag or purse with a zipper closure. If the zipper is closed, the zipper controller may be used to control the ring tone of the cellular phone so that it rings more loudly; whereas, if the zipper is open, indicating that the bag is open, the ring tone volume may be reduced. In this way, the user is more likely to hear the louder ring tone when the cellular phone is stored within the closed carrying bag, but the ring tone level is reduced automatically if the bag is unzipped.

The zipper controller may be used in bag or pocket to define the ring tone intensity of a mobile phone carried in the bag. While an open zipper on an open bag or pocket results in the loudest possible ring sound, the closing of the zipper decreases the sound level until finally a completely closed zipper "suffocates" the ring sound. This state can also activate silent cues such as embedded lights or a wearable vibrating motor to alert the user without using sound. The opening of the zipper results in an decreased sound level until finally a completely opened zipper results in the normal operating sound level used when the phone is in normal use.

A zipper controller may be used in bag or pocket to define the amount of personal information to be revealed in electronic business cards sent by mobile phones. The more the zipper is opened the more the user exposes personal information. The user may position the slider to define the degree of information is to be revealed, and then presses the button switch on the zipper's slider in order to transmit the information.

Opening the zipper and opening a pocket works well as a metaphor for taking out wallet and thus paying. The degree of opening determines the price intended to pay. The above-described modified zipper can be thus used in bag or pocket to bid in auctions, indicating intentions of paying a specific price or simply paying at all while being in a mobile environment. This is used in conjunction with a mobile or PDA, which works as visual display for the transaction.

When used with a mobile phone or PDA in which the screen resolution is limited, the zipper provides an alternative method to scroll through large collections of text, such as phone directory or a document.

As illustrated in FIG. 4 which shows how a zipper select a letter of the alphabet by positioning the slider next to a printed character and pressing the slider pushbutton to select that character. Alternatively, the zipper may be used to scroll through a nested list of displayed characters shown, for example, on a PDA or cellular phone display. Used in combination with a word prediction algorithm, this method of spelling small amounts of text is competitive to traditional key based entry methods.

CONCLUSION

It is to be understood that the methods and apparatus which have been described above are merely illustrative applications of the principles of the invention. Numerous modifications may be made by those skilled in the are without departing from the true spirit and scope of the invention.

What is claimed is:

1. A remote control device for transmitting digital control commands to remotely located electronic utilization device using a standard interface protocol comprising, in combination:

a zipper fastener consists of opposing rows of interlocking teeth attached to a pair of elongated flexible supports, a manually movable sliding traveler that locks and unlocks said teeth at is moves longitudinally along the length of said flexible supports, a sensor coupled to said zipper fastener for generating a variable analog position signal having a magnitude that varies progressively as said zipper fastener is moved and that indicates the current longitudinal position of said sliding traveler with respect to said supports, an analog to digital converter for translating said magnitude of said analog position signal into a digital control command indicative of the current position of said slider, and a wireless transmitter coupled to said sensor for sending digital control command to said remote utilization device using said standard interface protocol.

2. A wireless remote control device as set forth in claim 1 wherein said wireless transmitter sends said digital control commands using the Bluetooth protocol and wherein said remote utilization device includes a Bluetooth receiver.

3. A wireless remote control device as set forth in claim 2 further including a manually operated switch carried by said sliding traveler for producing a selection signal when activated by said user.

4. A wireless remote control device as set forth in claim 3 wherein said selection signal is transmitted as a Bluetooth command to said remote utilization device when said manually operated switch is actuated by said user.

5. A wireless remote control device as set forth in claim 1 wherein adjacent teeth in each of said rows of interlocking teeth are interconnected with a resistive metal allow wire and wherein said zipper fastener establishes an electrical connection between the resistive wire in each of said rows of teeth, and wherein said sensor measure the resistance of the circuit path through said resistive wires and said electrical connection.

6. A wireless remote control device as set forth in claim 5 wherein said wireless transmitter sends said control commands using the Bluetooth protocol and wherein said remote utilization device includes a Bluetooth receiver.

7. A wireless remote control device as set forth in claim 5 further including a manually operated switch carried by said sliding traveler for producing a selection signal when activated by said user.

8. A wireless remote control device as set forth in claim 1 wherein an array of Hall effect devices is distributed along the length of one of said supports, wherein said movable sliding traveler carries a magnet for activation each given one of said Hall effect devices when said traveler is near said give one of said Hall effect devices, and wherein said sensor generates a position signal that identifies that Hall effect device nearest to said movable traveler.

9. A wireless remote control device as set forth in claim 8 wherein said wireless transmitter sends said control commands using the Bluetooth protocol and wherein said remote utilization device includes a Bluetooth receiver.

10. A wireless remote control device as set forth in claim 8 further including a manually operated switch carried by said sliding traveler for producing a selection signal when activated by said user.

11. A wireless remote control device as set forth in claim 1 further including a manually operated switch carried by said sliding traveler for producing a selection signal when activated by said user.

* * * * *